US006332797B1

(12) United States Patent
Taguchi et al.

(10) Patent No.: US 6,332,797 B1
(45) Date of Patent: Dec. 25, 2001

(54) WATERPROOF CONNECTOR

(75) Inventors: Naoto Taguchi; Tohru Kurosawa, both of Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/680,504

(22) Filed: Oct. 5, 2000

(30) Foreign Application Priority Data

Oct. 13, 1999 (JP) ..... 11-291113

(51) Int. Cl.[7] ..... H01K 13/52
(52) U.S. Cl. ..... 439/275; 439/587
(58) Field of Search ..... 439/587, 271–272, 439/273, 274, 275, 589, 752

(56) References Cited

U.S. PATENT DOCUMENTS

| | | | | |
|---|---|---|---|---|
| 4,940,421 | * | 7/1990 | Kano et al. | 439/273 |
| 4,973,268 | * | 11/1990 | Smith et al. | 439/595 |
| 4,978,314 | * | 12/1990 | Maejima | 439/398 |
| 5,197,898 | | 3/1993 | Nagamine | 439/271 |
| 5,618,206 | * | 4/1997 | Sawada et al. | 439/587 |
| 5,671,311 | * | 9/1997 | Stillie et al. | 385/89 |
| 5,879,201 | * | 3/1999 | Fukamachi et al. | 439/752 |
| 6,053,754 | * | 4/2000 | Kano et al. | 439/281 |
| 6,152,752 | * | 11/2000 | Fukuda | 439/275 |

FOREIGN PATENT DOCUMENTS

H1-146478 10/1989 (JP) .

* cited by examiner

*Primary Examiner*—Tho D. Ta
*Assistant Examiner*—James Harvey
(74) *Attorney, Agent, or Firm*—Finnegan, Henderson, Farabow, Garrett & Dunner, L.L.P.

(57) ABSTRACT

In a waterproof connector M in which a waterproof seal member 60 is held between a connector housing 30 and a rear holder 70, and an electric wire seal portion closely attached to an outer periphery of an electric wire so as to seal between the electric wire and the connector housing 30 and a connector seal portion 60B for sealing between both of the connector housings at a time of fitting to an opposing connector housing are integrally formed in the waterproof seal member 60, wherein the connector seal portion 60B is provided on an outer peripheral surface of the rear holder 70 in an exposed manner so as to be closely attached to an inner periphery of a hood portion of the opposing connector housing at a time of fitting the connector housing 30 to the opposing connector housing.

10 Claims, 6 Drawing Sheets

RRIOR ART

RRIOR ART

RRIOR ART

WATERPROOF CONNECTOR

BACKGROUND OF THE INVENTION

The present invention relates to a waterproof connector structured such as to press a waterproof seal member attached to a rear end of a connector housing by a rear holder.

A waterproof connector requires two functions comprising an electric wire seal function for sealing between an electric wire and a connector housing and a connector seal function for sealing between both connectors at a time of fitting a connector to an opposing connector.

In conventional, a waterproof connector structured such that these two functions are achieved by one waterproof seal member so as to reduce the number of parts and a time and labor for assembly is exemplified by a structure shown in FIGS. 1 and 2.

FIG. 1 shows an example of a waterproof connector 1 described in U.S. Pat. No. 5,197,898 and FIG. 2 shows an example of a waterproof connector 11 described in Japanese Unexamined Utility Model Publication No. 1-146478. Simultaneously explaining the both, these waterproof connectors 1 and 11 have male type connector housings 2 and 12, mat-shaped waterproof seal members 3 and 13 attached to rear ends thereof, and rear holders 4 and 14 attached to rear portions thereof and engaged with the connector housings 2 and 12 so as to press the waterproof seal members 3 and 13 to the connector housings 2 and 12. Hood portions 5 and 15 are attached to the rear holders 4 and 14, and lock mechanisms 6 and 16 for locking with female side connectors 10 and 20 are provided in the hood portions 5 and 15.

A plurality of terminals 7 and 17 are inserted to inner portions of the connector housings 2 and 12 from rear portions, and electric wires 8 and 18 connected to the respective terminals 7 and 17 extend rearward the waterproof connectors 1 and 11 through respective through holes 9 and 19 of the waterproof seal members 3 and 13. The mat-shaped main body portions having the through holes 9 and 19 correspond to electric wire seal portions 3A and 13A. In addition to the mat-shaped electric wire seal portions 3A and 13A, connector seal portions 3B and 13B for sealing gaps between both the connectors 1, 10, 11 and 20 at a time of fitting to the opposing female connectors 10 and 20 are integrally provided in the waterproof seal members 3 and 13. In the case of these waterproof connectors 1 and 11, the connector seal portions 3B and 13B are arranged within the hood portions 5 and 15.

In this case, as mentioned above, in the conventional waterproof connectors 1 and 11, since the connector seal portions 3B and 13B of the waterproof seal members 3 and 13 are protected by the hood portions 5 and 15, there is a problem that outer shapes of the waterproof connectors 1 and 11 are increased at a degree that the hood portions 5 and 15 are provided.

SUMMARY OF THE INVENTION

The present invention has been made by taking the matters mentioned above into consideration, and an object of the present invention is to provide a waterproof connector which intends to further reduce a size.

A first aspect of the invention provides a waterproof connector comprising: a connector housing having a terminal receiving chamber; a waterproof seal member attached to a rear end of the connector housing; a rear holder for pressing the waterproof seal member to the connector housing; an electric wire seal portion closely attached to an outer periphery of an electric wire extending rearward from a terminal inserted to the terminal receiving chamber so as to seal between the electric wire and the connector housing; a connector seal portion for sealing between both of the connector housings at a time of fitting the connector housing to an opposing connector housing; and the electric wire seal portion and the connector seal portion being integrally formed in the waterproof seal member, wherein the connector seal portion of the waterproof seal member is provided on an outer peripheral surface of at least one of the connector housing and the rear holder in an exposed manner so as to be closely attached to an inner periphery of a hood portion of the opposing connector housing at a time of fitting the connector housing to the opposing connector housing.

In accordance with the waterproof connector, since the connector seal portion of the waterproof seal member is provided on the outer peripheral surface of at least one of the connector housing and the rear holder in an exposed manner, it is possible to make an outer shape of the connector compact at a degree that the hood portion is omitted.

A second aspect of the invention provides a waterproof connector according to the first aspect, wherein the connector seal portion of the waterproof seal member is constituted by a thin outer peripheral wall fitted to an outer periphery of the rear holder, and the connector seal portion constituted by the thin outer peripheral wall is supported by an outer peripheral wall of the rear holder made of a material harder than the waterproof seal member from an inner side.

In accordance with the waterproof connector, since the connector seal portion is constituted by the thin outer peripheral wall and is supported by the hard rear holder from the inner side, it is easy to properly control an elasticity of the connector seal portion and there is not a risk that the connector seal portion is excessively deformed and the sealing property is deteriorated. Further, it is possible to prevent the sealing property from being reduced due to deterioration of the connector seal portion.

A third aspect of the invention provides a waterproof connector according to the first aspect or the second aspect, wherein an annular convex portion is provided on the outer peripheral surface of the connector seal portion so as to be continuous in a peripheral direction.

In accordance with the waterproof connector, since the annular convex portion is provided on the outer peripheral surface of the connector seal portion, it is possible to increase a close attaching property of the opposing connector with respect to the inner peripheral surface of the hood portion.

A fourth aspect of the invention provides a waterproof connector according to any one of the first to third aspects, wherein a lock arm engaging with an engaging portion of the inner periphery of the hood portion of the opposing connector housing at a time of fitting to the opposing connector housing is arranged at a front position of the connector seal portion in the connector housing in such a manner as to be retracted to the inner peripheral side from the connector seal portion.

In the conventional waterproof connector, the lock means with respect to the opposing connector is provided in the hood portion, however, in accordance with the waterproof connector of the present invention, there is no portion to be provided with the lock means because the hood portion is omitted. Then, the lock arm is arranged at the front position of the connector seal portion. Further, by arranging at the position retracted to the inner peripheral side from the connector seal portion, the structure is made such that the hood portion of the opposing connector can pass through the lock arm and reach the connector seal portion. Further, by arranging the lock arm in such a manner as to be retracted to the inner peripheral side from the connector seal portion as mentioned above, the waterproof connector can be made compact.

BRIEF DESCRIPTION OF THE DRAWINGS

FIGS. 2A and 2B are views showing another embodiment of a conventional waterproof connector, in which FIG. 2A is a cross-sectional view taken along a horizontal surface and FIG. 2B is a cross-sectional view taken along a ling IIB—IIB in FIG. 2A;

DESCRIPTION OF THE PREFERRED EMBODIMENT

Figure 1:
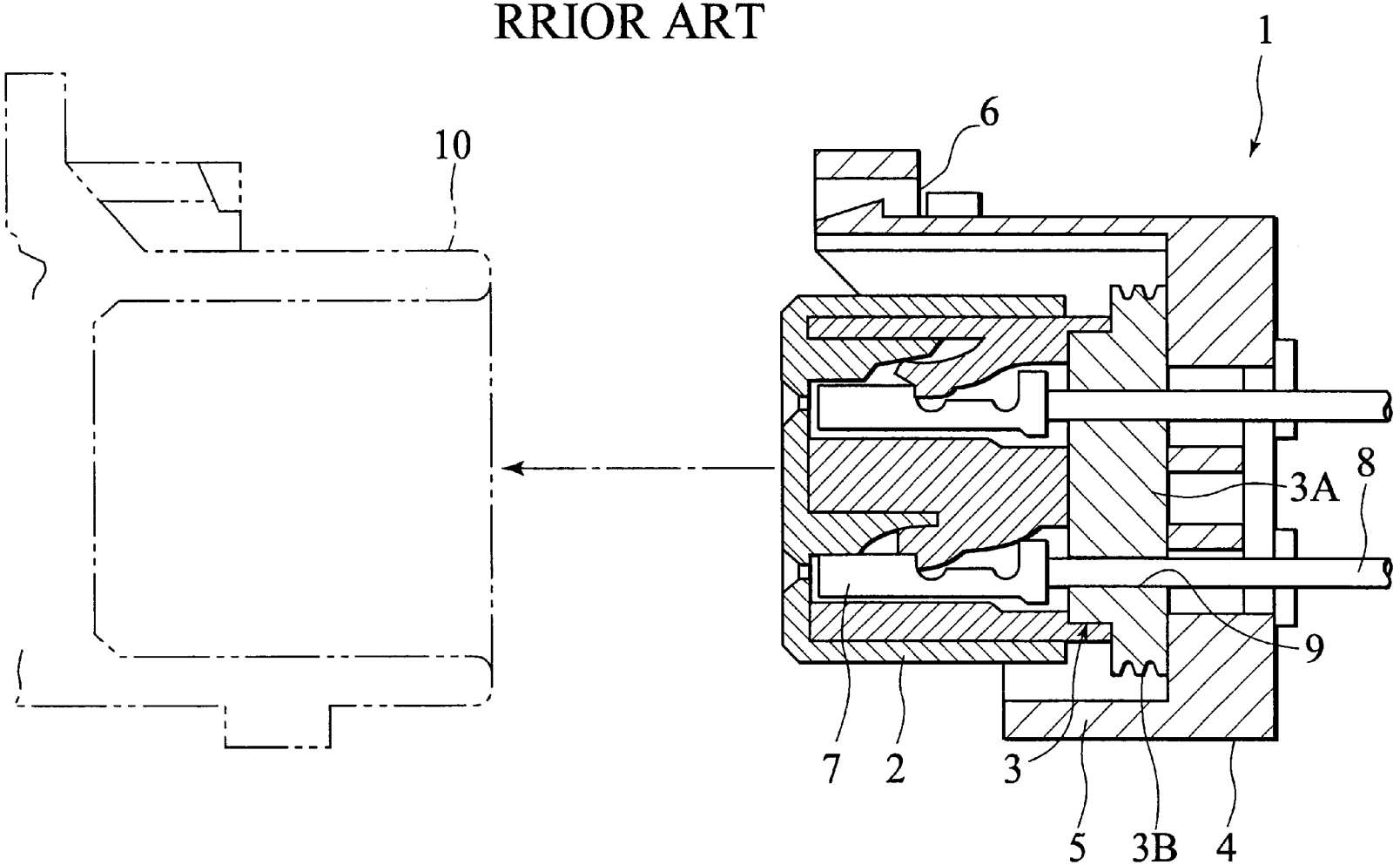
FIG. 1 is a cross-sectional view showing an embodiment of a conventional waterproof connector.
Figure 2A:
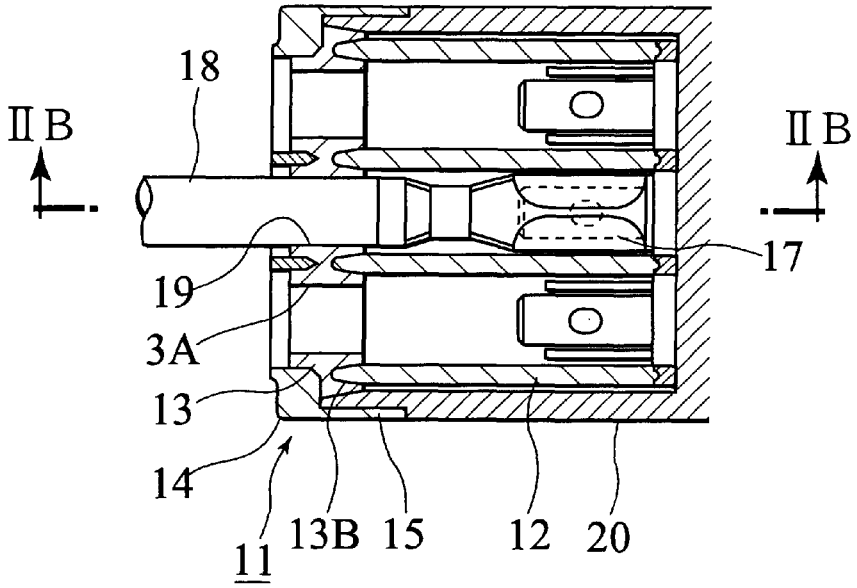
Figure 2B:
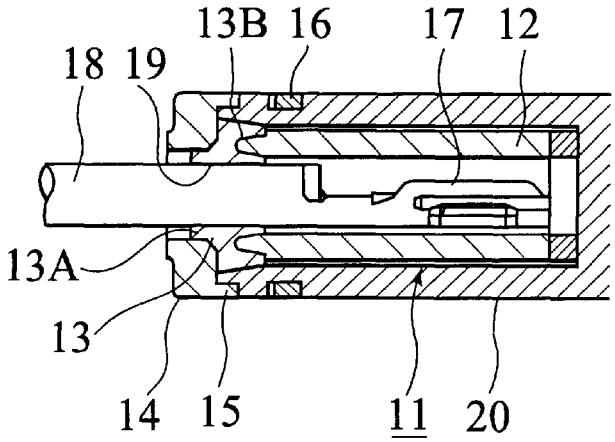
Figure 3:
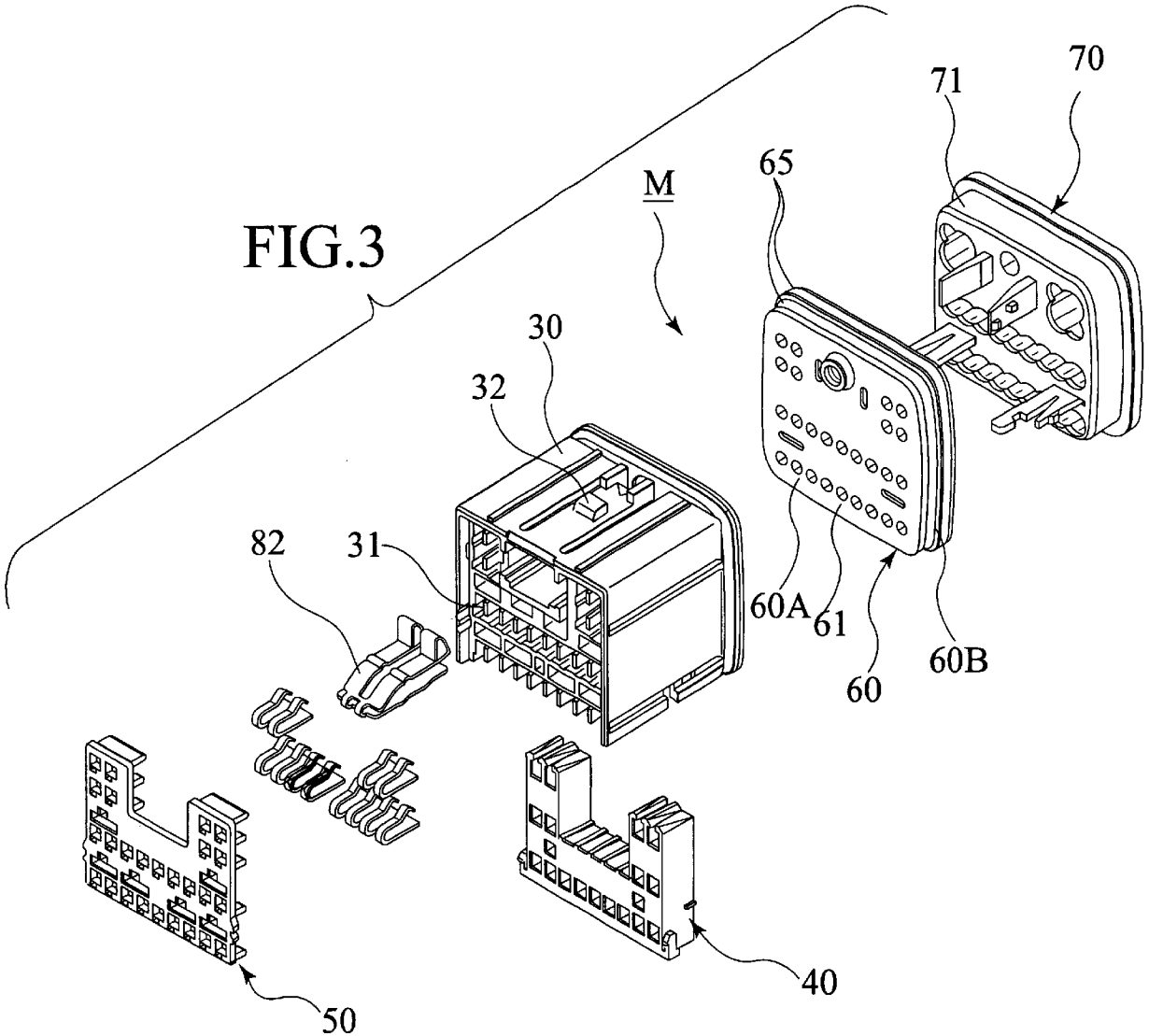
FIG. 3 is an exploded perspective view of a waterproof connector in accordance with en embodiment of the present invention.
Figure 4:
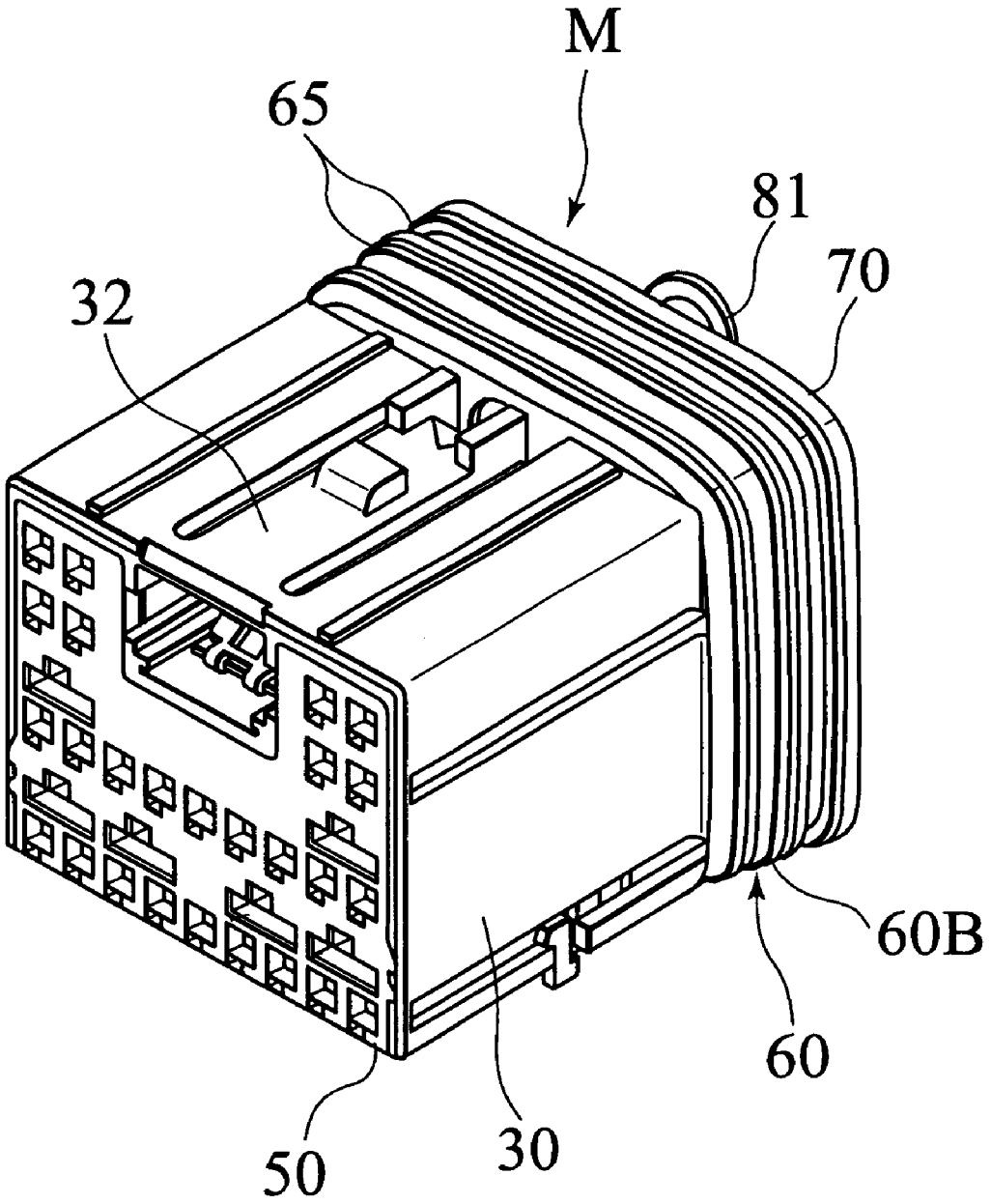
FIG. 4 is a perspective view of an outer appearance showing an assembled state of the waterproof connector in accordance with the embodiment of the present invention.
Figure 5:
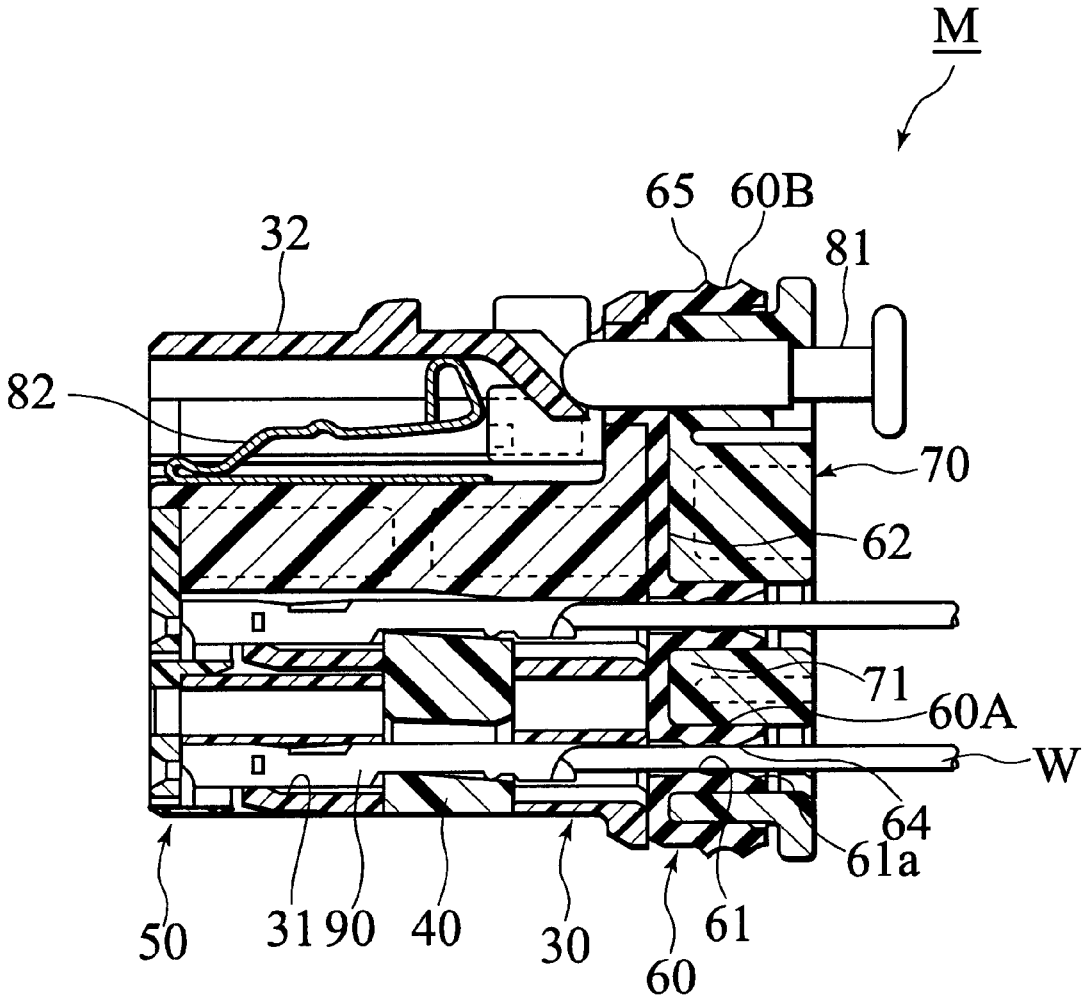
FIG. 5 is a cross-sectional view of an assembled state of the waterproof connector in accordance with the embodiment of the present invention.
Figure 6:
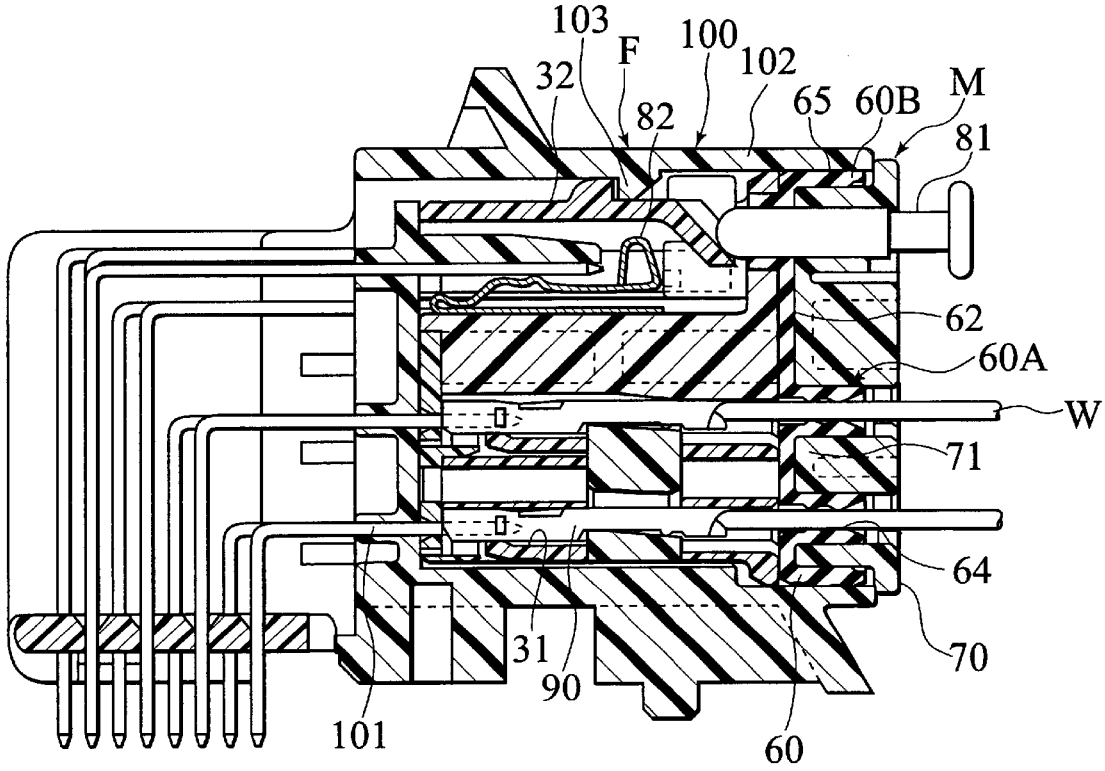
FIG. 6 is a cross-sectional view showing a fitting state between the waterproof connector in accordance with the embodiment of the present invention and an opposing connector.

As shown in FIGS. 5 and 6, a waterproof connector M is provided with a hard synthetic resin male type connector housing 30 having a plurality of terminal receiving chambers 31, a female terminal 90 mounted to a front end of an electric wire W and inserted and set in each of the terminal receiving chambers 31 of the connector housing 30, a hard synthetic resin spacer 40 attached to a lower side of the connector housing 30 and engaging with the female terminal 90 received in each of the terminal receiving chambers 31, a hard synthetic resin front cover 50 attached to a front surface of the connector housing 30 from a lower side and guiding a connection of a male terminal 101 of a connector F in a female side to the female terminal 90, a thermoplastic elastomer resin mat-shaped waterproof seal member 60 having a plurality of electric wire inserting holes 61 corresponding to the respective terminal receiving chambers 31 and closely attached to a rear end surface of the connector housing 30, and a hard synthetic resin rear holder 70 for pressing the mat-shaped waterproof seal member 60 to the rear end surface of the connector housing 30. Further, in addition, there are provided a lock canceling pin (a canceling member) 81 for canceling the lock means at a time of being fitted to the connector F in the female side, a short-circuit terminal 82 for detecting a semi-fitting of the connector and the like.

A lock arm 32 mutually locking with an engaging portion 103 on an inner periphery of a hood portion 102 of a connector housing 100 in a female side at a time of being fitted to the connector F in the female side is provided in an upper surface portion of the connector housing 30. The lock arm 32 is supported in an overhung manner at a front end, and a free end thereof extends rearward along the upper surface of the connector housing 30.

The waterproof seal member 60 held between a rear wall surface of the connector housing 30 and the rear holder 70 integrally has a mat-shaped electric wire seal portion 60A for sealing a through portion of the electric wire W and a connector seal portion 60B for sealing a fitted portion between both of the connectors M and F. A plurality of electric wire through holes 61 are formed in the electric wire seal portion 60A and recess portions 62 are formed in a rear surface side while leaving a cylindrical thickness portion 61*a* in the periphery of each of the electric wire inserting holes 61. Pressing convex portions 71 of the rear holder 70 are press inserted to these recess portions 62.

An outer peripheral portion of each of the recess portions 62 is defined by a thin outer peripheral wall having the same height as a protruding height of the cylindrical thickness portion 61*a,* and the outer peripheral wall constitutes the connector seal 60A. The connector seal portion 60A corresponds to a portion attaching to the inner periphery of the hood portion 102 of the connector housing 100 in the female side so as to seal between both of the connectors M and F at a time of fitting to the connector F in the female side as shown in FIG. 6, and is exposed to the outer peripheral portion at the rear end of the waterproof connector M in a state of fitting to the outer periphery of the rear holder 70. Then, the connector seal portion 60B is set so as to be positioned in the outer peripheral side rather than the other portions of the waterproof connector M, and the lock arm 32 is retracted to the inner peripheral side from the connector seal portion 60B.

Further, annular convex portions 64 having a corrugated cross section and arranged in two stages in a direction of passing through the electric wire inserting hole 61 are provided on the inner peripheral surface of the electric wire inserting hole 61 surrounded by the cylindrical thickness portion 61*a* in order to increase a sealing property with respect to the electric wire W. In the same manner, annular convex portions 65 having a corrugated cross section and arranged in two stages are provided on the outer peripheral surface of the connector seal portion 60B in order to increase a sealing property with respect to the connector housing 100 in the female side at a time of fitting to the connector F in the female side.

Then, the pressing convex portion 71 of the rear holder 70 is press inserted to the recess portion 62 of the waterproof seal member 60, thereby applying a pressing force to the waterproof seal member 60, increasing the sealing property of the cylindrical thickness portion 61*a* with respect to the electric wire W, and pressing and supporting the connector seal portion 60B constituted by the thin outer peripheral wall from the inner side.

Next, a description will be given of an operation.

In the waterproof connector M, the connector seal portion 60B of the waterproof seal member 60 is exposed to the outer peripheral surface at the rear end of the waterproof connector M in a state of fitting to the outer peripheral surface of the rear holder 70. As mentioned above, by forcibly exposing the connector seal portion 60B outward so as to omit the hood portion, it is possible to make the outer shape of the waterproof connector M small. Further, the lock arm 32 a position for placing of which is lost due to the omission of the hood portion is arranged at the front position from the connector seal portion 60B in such a manner as to be retracted to the inner peripheral side from the connector seal portion 60B. Accordingly, it is possible to take the hood portion 102 of the opposing connector F to the connector seal portion 60B with passing through the lock arm 32 with no trouble. As mentioned above, since the lock arm 32 is arranged in such a manner as to be retracted to the inner peripheral side from the connector seal portion 60B, the waterproof connector M can be made compact.

Further, since the connector seal portion 60B constituted by the thin outer peripheral wall is backed up by the pressing convex portion 71 of the hard rear holder 70 from the inner side, it is possible to properly control a sealing property of the connector seal portion 60B by securing an accuracy of size of the rear holder 70, so that there is no case that the connector seal portion 60B is excessively deformed and the sealing property becomes unstable. Further, due to the back-up by the rear holder 70, it is possible to prevent the sealing property from being reduce due to the deformation of the connector seal portion 60B.

In this case, in the embodiment mentioned above, the structure is made such that the connector seal portion 60B of the waterproof seal member 60 is fitted to the outer periphery of the rear holder 70, however, the structure may be made such that it is fitted to the connector housing 30 side.

What is claimed is:

1. A waterproof connector comprising:

a connector housing having a terminal receiving chamber;

a waterproof seal member attached to a rear end of said connector housing, said seal member comprising a mat-shaped portion having a front surface contact with the rear end of said connector housing and a rear surface, an electric wire seal portion forming at least one wire receiving hole extending through the mat-shaped portion, and a connector seal portion forming a thin outer peripheral wall around a periphery of the mat-shaped portion and extending from said rear surface of said mat-shaped portion of said seal member, said connector seal portion being configured to seal between two connector housings when said connector housing is fit to an opposing connector housing;

a rear holder for pressing said waterproof seal member to the connector housing; and an electric wire extending rearward from a terminal inserted to said terminal receiving chamber, the electric wire seal portion closely attached to an outer periphery of the wire so as to seal between the electric wire and the connector housing;

wherein the connector seal portion of said waterproof seal member is provided on an outer peripheral surface of at least one of said connector housing and said rear holder in an exposed manner so as to be closely attached to an inner periphery of a hood portion of the opposing connector housing at a time of fitting said connector housing to the opposing connector housing.

2. A waterproof connector according to claim 1, wherein the thin outer peripheral wall is supported from inside by an outer peripheral wall of the rear holder made of a material harder than said waterproof seal member.

3. A waterproof connector according to claim 1, wherein an annular convex portion is provided on the outer peripheral surface of said connector seal portion so as to be continuous in a peripheral direction.

4. A waterproof connector according to claim 1, wherein a lock arm engaging with an engaging portion of the inner periphery of the hood portion of the opposing connector housing at a time of fitting to the opposing connector housing is arranged at a front position of said connector seal portion in said connector housing in such a manner as to be retracted to an inner peripheral side from said connector seal portion.

5. A waterproof connector according to claim 1, wherein the at least one wire receiving hole includes an inner annular convex portion.

6. A waterproof connector according to claim 1, wherein the electric wire seal portion includes a plurality of wire receiving holes.

7. A waterproof connector according to claim 1, wherein said waterproof seal member is elastomeric.

8. A waterproof connector according to claim 1, wherein said mat-shaped portion is flat.

9. A waterproof connector according to claim 1, wherein said seal member includes at least one recessed area between said at least one wire receiving hole and said outer peripheral wall.

10. A waterproof connector according to claim 9, wherein the at least one recessed portion of the seal member is configured to receive an outer peripheral wall of the rear holder.

* * * * *

UNITED STATES PATENT AND TRADEMARK OFFICE

CERTIFICATE OF CORRECTION

PATENT NO. : 6,332,797 B1
DATED : December 25, 2001
INVENTOR(S) : Naoto Taguchi and Tohru Kurosawa It is certified that error appears in the above-identified patent and that said Letters Patent is hereby corrected as shown below:

Column 5,
Line 26, "surface contact" should read -- surface in contact --.

Signed and Sealed this

Eighth Day of October, 2002

*Attest:*

*Attesting Officer*

JAMES E. ROGAN
*Director of the United States Patent and Trademark Office*